US011952180B2

(12) United States Patent
Oviatt

(10) Patent No.: US 11,952,180 B2
(45) Date of Patent: Apr. 9, 2024

(54) TRAY CONTAINER

(71) Applicant: Chad G. Oviatt, Galesburg, MI (US)

(72) Inventor: Chad G. Oviatt, Galesburg, MI (US)

(73) Assignee: ARVCO CONTAINER CORPORATION, Kalamazoo, MI (US)

( * ) Notice: Subject to any disclaimer, the term of this patent is extended or adjusted under 35 U.S.C. 154(b) by 270 days.

(21) Appl. No.: 17/027,894

(22) Filed: Sep. 22, 2020

(65) Prior Publication Data

US 2021/0094721 A1 Apr. 1, 2021

Related U.S. Application Data

(60) Provisional application No. 62/907,916, filed on Sep. 30, 2019.

(51) Int. Cl.
*B65D 5/30* (2006.01)
*B65D 5/489* (2006.01)

(52) U.S. Cl.
CPC ..... *B65D 5/302* (2013.01); *B65D 5/4802* (2013.01)

(58) Field of Classification Search
CPC ..... B65D 5/305; B65D 5/003; B65D 5/5037; B65D 5/503; B65D 5/4802; B65D 5/5038
See application file for complete search history.

(56) References Cited

U.S. PATENT DOCUMENTS 5,649,663 A * 7/1997 Pestow, Jr. ..... B65D 5/0045 229/174
2020/0172294 A1* 6/2020 Wittenberg ..... B65D 5/4295

* cited by examiner

*Primary Examiner* — Anthony D Stashick
*Assistant Examiner* — Lauren Kmet
(74) *Attorney, Agent, or Firm* — FLYNN THIEL, P.C.

(57) ABSTRACT

A tray for holding food or other items is provided. The tray includes a base, a curved top, and an inner space. A one-piece blank to form such a tray is also provided.

10 Claims, 9 Drawing Sheets

TRAY CONTAINER

CROSS-REFERENCE TO RELATED APPLICATION

This claims the benefit of U.S. Provisional Application No. 62/907,916, filed Sep. 30, 2019, the disclosure of which is hereby incorporated by reference in its entirety.

FIELD OF THE INVENTION

This invention generally relates to a container, and more specifically relates to a container made of a foldable material and formed from a one-piece blank.

BACKGROUND AND SUMMARY OF THE INVENTION

Containers of various sizes, shapes, and structures have been made to hold items in a drugstore, grocery store, or at a sporting event. While certain containers are available, these containers require an abundance of material and labor to prepare the container blank for use. The container of the present invention does not suffer from these problems.

One example of an embodiment of the present invention is a one-piece tray blank of a foldable material which comprises a first panel having a front edge, a first side edge, a second side edge, and a rear edge. The blank also has a second panel hingedly joined to the first panel rear edge, the junction of the second panel and the first panel having at least one slot therein. A third panel is hingedly joined to the first side edge, and has a first curved edge. A fourth panel is hingedly joined to the second side edge and has a second curved edge. A fifth panel is joined to the first panel and has an outer strip at least partially defining an inner opening, the outer strip having at least one outer strip edge. A sixth panel is hingedly attached to the outer strip at the outer strip edge, the sixth panel having a tab for insertion into the slot.

Another example of an embodiment of the present invention is a tray container comprising a substantially rectangular base, a first sidewall connected to the base, the first sidewall having a first curved edge, a second sidewall connected to the base, the second sidewall having a second curved edge, and a first rear wall portion connected to the base. A space is located adjacent the base and the rear wall, and is preferably defined by one of the base and the rear wall. The first sidewall, the second sidewall, the first rear wall portion and the base at least partially defining an inner opening. The tray also includes a curved top portion having an outer strip adjacent the inner opening. A second rear wall portion is connected to the outer strip and is disposed adjacent the first rear wall portion. A tab is connected to the second rear wall portion and inserted into the space.

Other advantages, objects and/or purposes of the invention will be apparent to persons familiar with constructions of this general type upon reading the following specification and inspecting the accompanying drawings.

DETAILED DESCRIPTION

Figure 1:
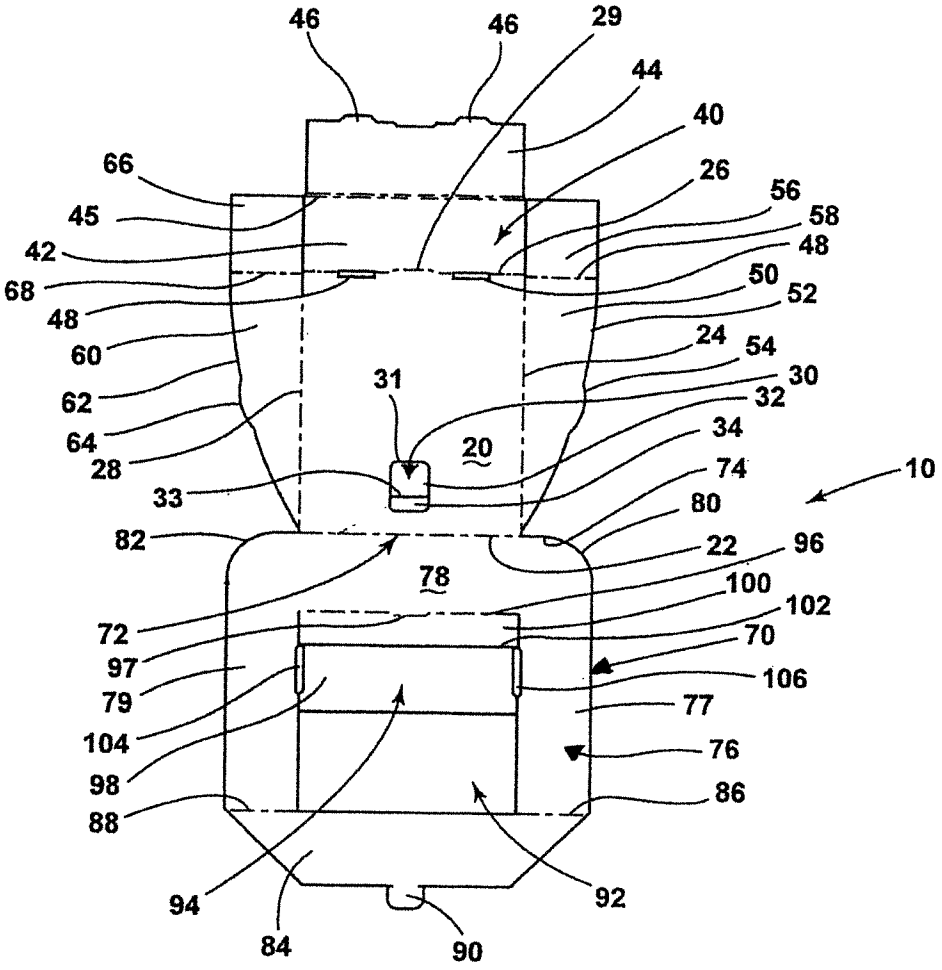
FIG. 1 is a top plan view of a first embodiment of a one-piece blank made of a foldable material.

Certain terminology will be used in the following description for convenience and reference only and will not be limiting. The words "up," "down," "left," and "right" will designate directions in the drawings to which reference is made. The words "front" and "rear" for the tray described herein will designate the front and rear of the tray as it is facing the reader in FIG. 2 and the other directions will follow accordingly. Such terminology will include derivatives and words of similar import.

Figure 2:
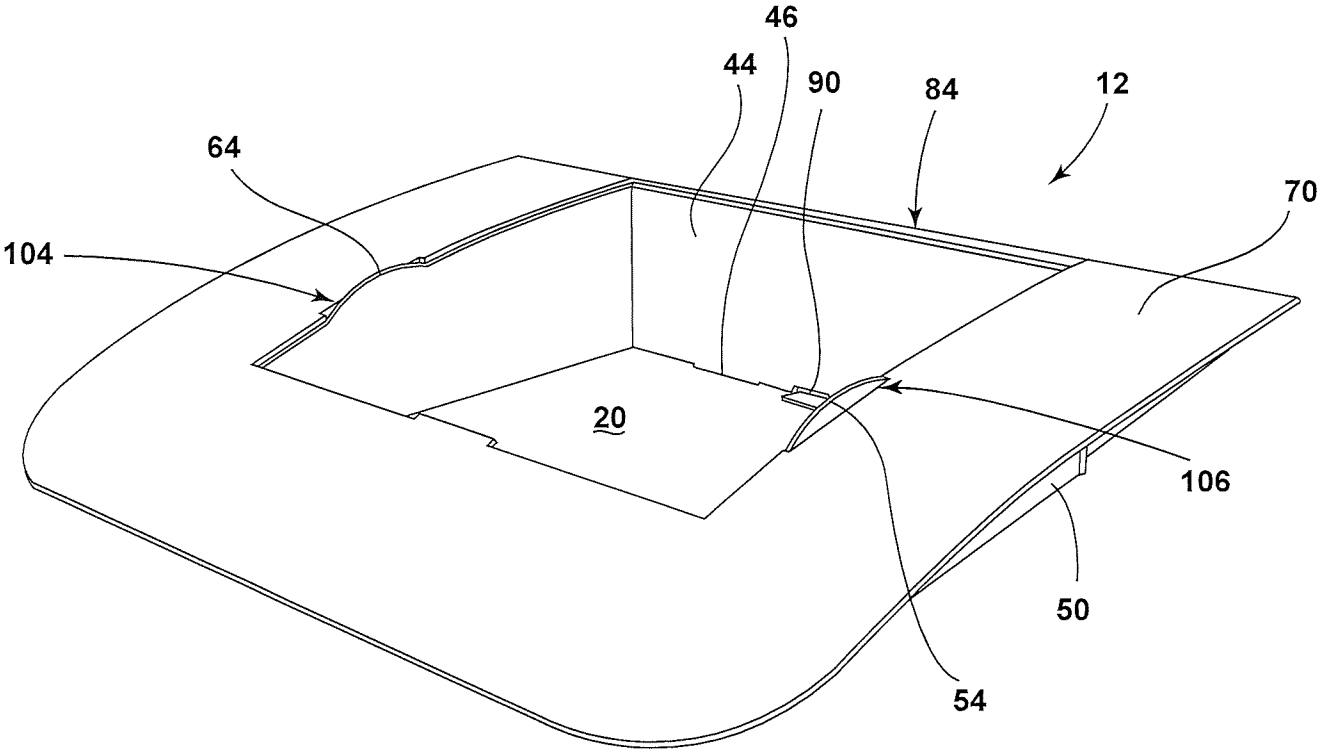
FIG. 2 is a front perspective view of a tray formed from the blank illustrated in FIG. 1.
Figure 3:
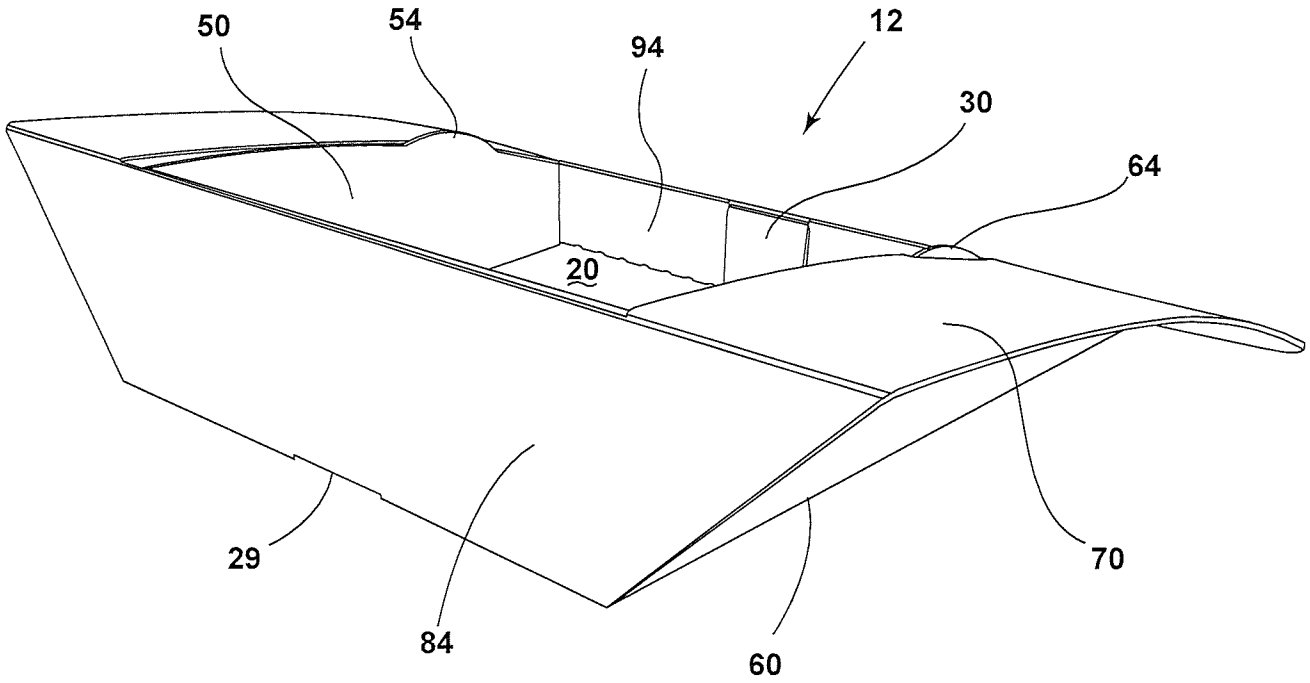
FIG. 3 is a rear perspective view of the tray of FIG. 2.

A first embodiment of a one-piece tray 12 is illustrated in FIGS. 1-3 and is made of a foldable material such as corrugated paper board. Referring to FIG. 1, the tray 12 is shown in blank form 10, which is preferably flat, and which has a substantially rectangular bottom panel 20. The bottom panel 20 has a front edge 22, a first side edge 24, a rear edge 26, and a second side edge 28. The front edge 22 is substantially parallel to the rear edge 26, and the first side edge 24 is substantially parallel to the second side edge 28. The rear edge 26 creates a fold line with a slot 29 therein, which is configured to receive a tab. It is contemplated that the slot 29 could be located elsewhere such as in a wall panel. Preferably, the bottom panel 20 has a tab 30 disposed therein which is centrally located left to right, and positioned toward the front of the tray 12 as it is shown in FIG. 2. The tab 30 is hingedly attached to the remainder of the bottom panel 20 at a tab rear edge 31 and also preferably has a crease 33 therein creating a first part 32 and a second part 34.

A rear panel 40 is hingedly attached to the bottom panel 20 at the rear edge 26 of the bottom panel 20. The rear panel 40 includes a first portion 42 and a second portion 44 which are hingedly attached to one another along a fold line 45. The second portion 44 of the rear panel 40 has two tabs 46 extending therefrom at its rear. The two tabs 46 are insertable into two apertures 48 which are both positioned in the bottom panel 20 at or adjacent the rear edge 26. The tabs 46 can be inserted into and reside at least partially within the apertures 48 when the blank is erected into the tray 12 shown in FIGS. 2-3.

A first side panel 50 is hingedly attached to the bottom panel 20 along the first side edge 24. The first side panel 50 has a curved outer edge 52 that preferably extends the entirety of the length of the first side panel 50. Substantially midway along the length of the curved outer edge 52 is a curved tab 54. The curved tab 54 is sized and shaped to reside in a slot as described in more detail below. A substantially square insert panel 56 is hingedly attached to the first side panel 50 along a fold line 58.

A second side panel 60 is hingedly attached to the bottom panel 20 along the second side edge 28. The second side panel 60 has a curved outer edge 62 that preferably extends the entirety of the length of the second side panel 60. Substantially midway along the length of the curved outer edge 62 is a curved tab 64. The curved tab 64 is sized and shaped to reside in a slot as described in more detail below. A substantially square insert panel 66 is hingedly attached to the second side panel 60 along a fold line 68.

A top panel 70 is hingedly attached to the bottom panel 20 along the front edge 22. The top panel 70 has a front edge, a portion 72 of which is hingedly attached to the bottom panel 20, and portions 74 which are not attached to the bottom panel 20 or any other part of the blank 10. The portions 72 and 74 preferably extend along the same axis. The top panel 70 has an outer strip 76 that has three portions 77, 78, 79 and has curved front corners 80, 82.

A second rear panel 84 is hingedly attached to the outer strip 76 of the top panel 70. The second rear panel 84 is preferably substantially trapezoidal in shape and is attached to the outer strip 76 at a first top rear edge 86 and a second top rear edge 88. The second rear panel 84 has a tab 90 extending therefrom, which is sized and shaped to fit in the slot 29. The tab 90 is hingedly attached to the second rear panel 84, and therefore can be moved with respect to the second rear panel 84.

The three portions 77, 78, 79 of the outer strip 76 and the second rear panel 84 together define an inner square-shaped space 92. A support portion 94 is hingedly attached to the outer strip 76 along an edge 96 within the space 92. The support portion 94 has a first part 98 and a second part 100 which are hingedly attached to one another along a fold line 102. The edge 96 has a centrally located slot 97 therein which is configured to receive a tab such as tab 30. Portions 77 and 79 have notches 104, 106 on their inner edges, adjacent the space 92. The notches 104, 106 are configured and positioned to receive the curved tabs 64, 54, respectively.

To erect the tray 12, the blank 10 is preferably laid flat or substantially flat. The side panels 50, 60 are moved to an upright position about the first side edge 24 and the second side edge 28, respectively. The side panels 50, 60 are preferably positioned substantially perpendicular to the plane in which the bottom panel 20 resides. The insert panels 56, 66 are then each folded inwardly with respect to the side panels 50, 60. The insert panels 56, 66 are positioned such that they are substantially perpendicular to both the plane in which the bottom panel 20 resides and the side panels 50, 60. The rear panel 40 is then folded upwardly about fold line 26, positioned substantially parallel with the insert panels 56, 66. The second part 44 of the rear panel 40 is then folded downwardly about fold line 45, with respect to the first part 42 of the rear panel 40 such that the second part 44 is substantially parallel with the first part 42, and is disposed over the insert panels 56, 66. The tabs 46 are then inserted into the apertures 48, which effectively holds the side panels 50 and 60, the insert panels 56 and 66, and the rear panel 40 in place.

The support portion 94 is then folded upwardly about the edge 96, followed by the first part 98 being folded about the fold line 102 toward the rear of the tray 12. The entire top panel 70 is then folded rearwardly about the front edge 22, causing the first part 98 of the support portion 94 to be folded under the portion 78 of the top panel 70. The top panel 70, especially the portions 77 and 79, are pressed downwardly until they reach the top of the curved tabs 54, 64. The side panels 50, 60 are positioned such that the curved tabs 54, 64 are positioned on the inside (i.e., within the space 92) of the inner portions of the portions 77, 79. The curved tab 54 is positioned within the notch 106 and the curved tab 64 is positioned within the notch 104. The top panel 70 is then continued to be pressed downwardly causing the portions 77, 79 to slightly curve and engage with the outer edge 52 of the first side panel 50 and the outer edge 62 of the second side panel 60, respectively. The second rear panel 84 is folded downwardly about fold lines 86, 88 with respect to portions 77, 79 such that the second rear panel 84 is positioned behind and substantially parallel to the first part 42 of the rear panel 40. The tab 90 is inserted into the slot 29 to hold the top panel 70 in place with respect to the bottom panel 20 and the side panels 50, 60.

The tab 30 is then folded upwardly with respect to the bottom panel 20 within the interior of the tray 12 and the first part 32 is folded toward the front of the tray along the crease 33. The first part 32 of the tab 30 is inserted into the slot 97 for additional stabilization.

The erected first embodiment tray 12 is shown in FIGS. 2-3. The tray has a clean look and a substantially rectangular or square centralized opening for storing or temporarily holding a variety of items.

The reference numeral 210 (FIGS. 4-6) generally designates another embodiment of the present invention, being a blank for a tray 212. Since the tray 212 and its blank 210 are similar to the previously described tray 12 and its blank 10, similar parts appearing in FIGS. 1-3 and 4-6, respectively, are represented by the same corresponding reference number, except that the parts in the embodiment shown in FIGS. 4-6 have 200 added to them with respect to the embodiment depicted in FIGS. 1-3.

Figure 4:
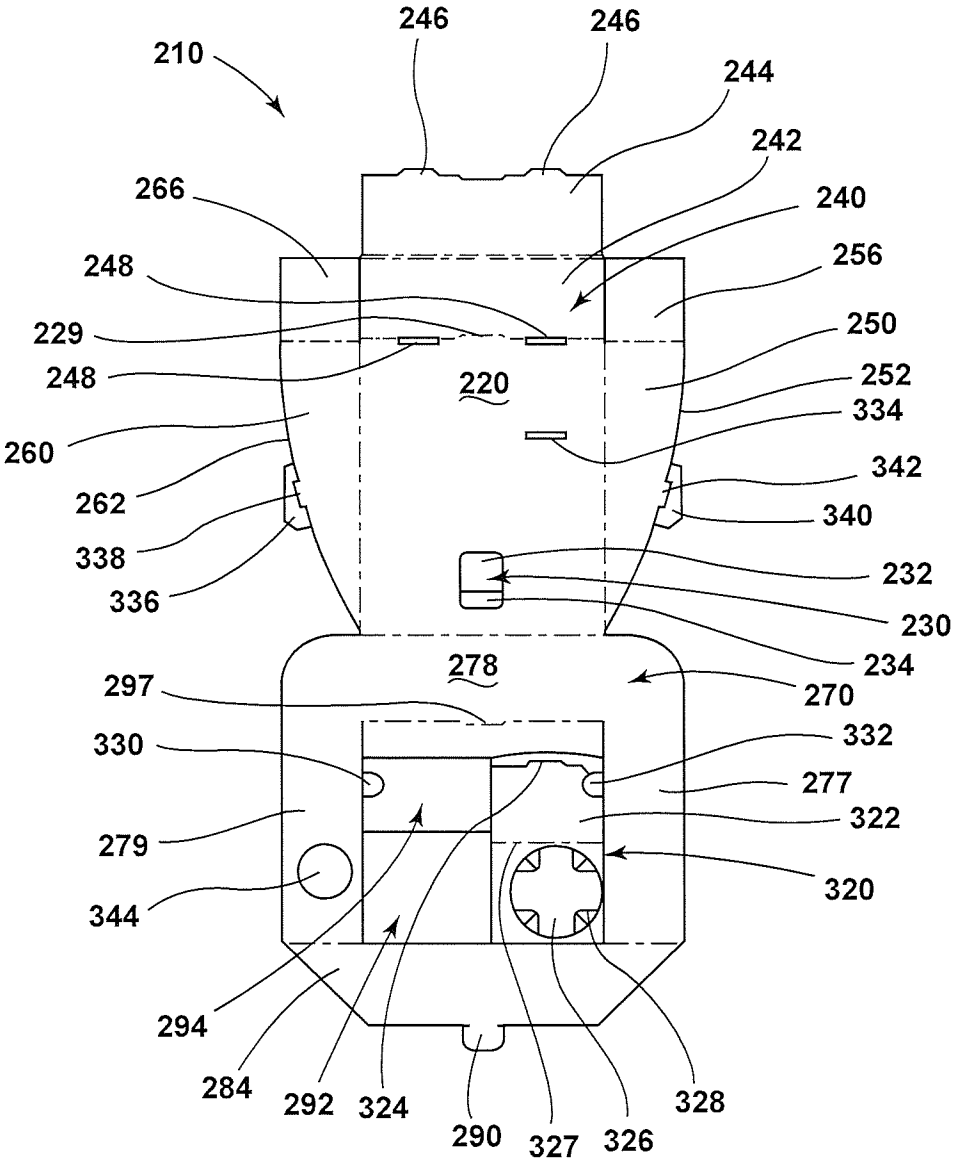
FIG. 4 is a top plan view of a second embodiment of a one-piece blank made of a foldable material.

As shown in FIG. 4, the blank 210 of this embodiment includes additional features and some differences from the first embodiment depicted in FIGS. 1-3. Specifically, in a generally square open space 292 there is the structure to provide a cup holder 320. The cup holder 320 includes a generally rectangular first part 322 having a tab 324 extending therefrom. A substantially round opening 326 is provided in a second part, which is adjacent the first part 322. A fold line 327 hingedly joins the first part 322 to the second part which includes the opening 326. The opening 326 has extensions 328 therein for providing friction to hold a cup or other item when the tray 212 is fully erected.

Extending inwardly from the top 270 are two opposing generally semi-circular shaped tabs 330, 332. The tabs 330, 332 are hingedly attached to the portions 279 and 277, respectively, of the top 270, and are configured to be inserted into slots defined by tabs 336, 340 extending from the side panels 260, 250 as explained in more detail below. A slot 334 is disposed in the bottom panel 220. The slot 334 is positioned and configured to receive the tab 324 when the tray 212 is erected.

The tabs 336 and 340 extend outwardly from the side panels 260 and 250, respectively. The tabs 336, 340 are irregular-polygonal shaped (see FIG. 4), but can be any shape that is desired. The tab 336 is hingedly attached to the side panel 260 along the line which creates the edge 262 of the side panel 260. The side panel 260 and the tab 336 together define a slot 338 between them, configured to receive the tab 330. Likewise, the tab 340 extends from the side panel 250 and is hingedly attached thereto along the line that defines the edge 252. The side panel 250 and the tab 340 define a slot 342 therebetween which is configured to receive the tab 332. It should be noted that the tab holding structure which includes the tabs 330, 332 and the tabs 336, 340 can be used in any of the embodiments herein and should not be deemed to be restricted to the instant embodiment.

An aperture 344 is also included in the top 270, preferably in the portion 279 or in any part that is opposite the cup holder 320. However, it is contemplated that such an aperture could be located wherever desired. The aperture 344 is provided to hold an item such as a sauce container or other item which has a lip for engaging the top 270 and holding the item in the tray 212.

Figure 5:
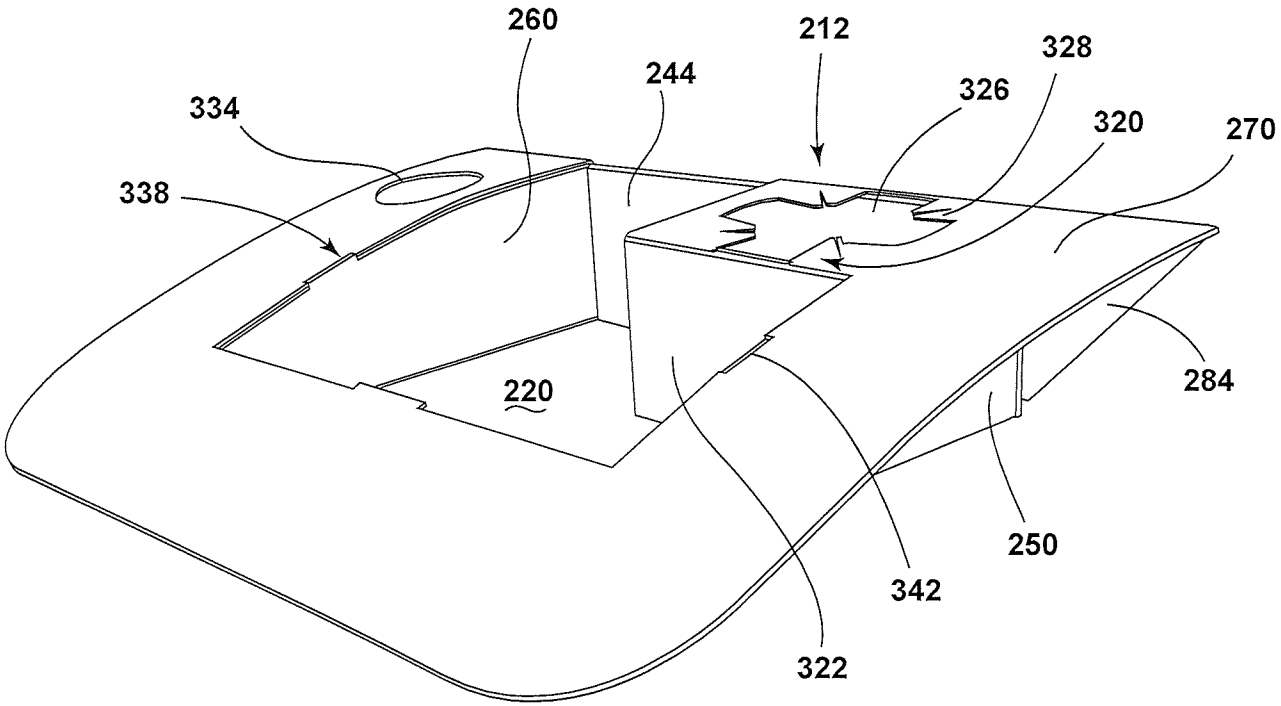
FIG. 5 is a front perspective view of a tray formed from the blank illustrated in FIG. 4.
Figure 6:
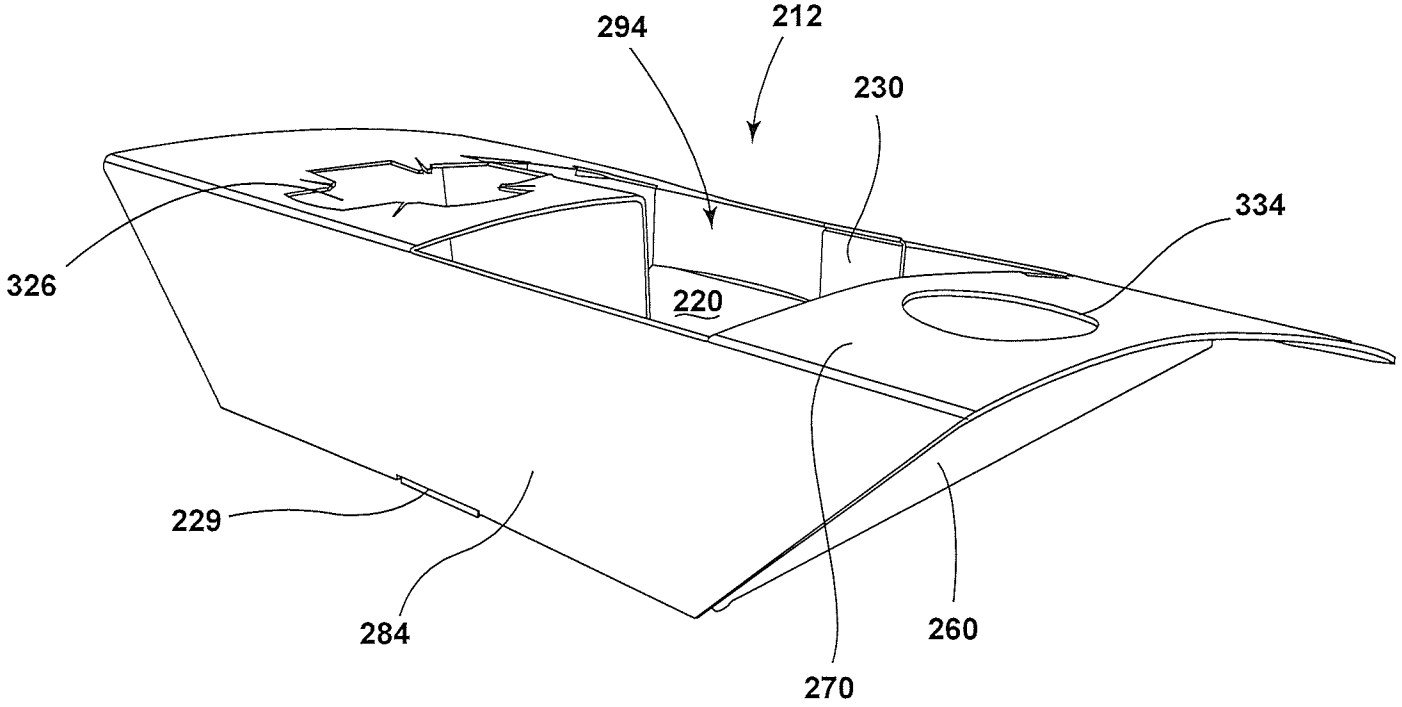
FIG. 6 is a rear perspective view of the tray of FIG. 5.

The tray 212 is erected in substantially the same manner as tray 12. However, in this embodiment, before the top 270 is folded over and engages with the side panels 250, 260, the tabs 336, 340 are bent outwardly, that is, folded outwardly with respect to the panels 260, 250, respectively, allowing the bottom side of the top 270 to be slightly curved and to sit flushly along the edges 262, 252 and the tabs 336, 340. The tab 330 is folded with respect to the top 270 and inserted into the slot 338, and the tab 332 is folded with respect to the top 270 and inserted into the slot 342. This connection system with the tabs allows a more flush/flat top surface of the tray 212 as shown in FIGS. 5-6. Also, after the tab 290 is inserted into the slot 229, the cup holder can be formed. The rectangular panel 322 is folded downwardly toward the bottom panel 220 and the tab 324 is inserted into the slot 334 to hold the cup holder 320 in place.

The reference numeral 410 (FIGS. 7-9) generally designates a blank of yet another embodiment of the present invention, which can be formed into a tray 412. Since the tray 412 and its blank 410 are similar to the previously described tray 212 and its blank 210, similar parts appearing in FIGS. 4-6 and 7-9, respectively, are represented by the same, corresponding reference number except that the parts in the embodiment depicted in FIGS. 7-9 have 200 added to them with respect to the embodiment depicted in FIGS. 4-6.

Figure 7:
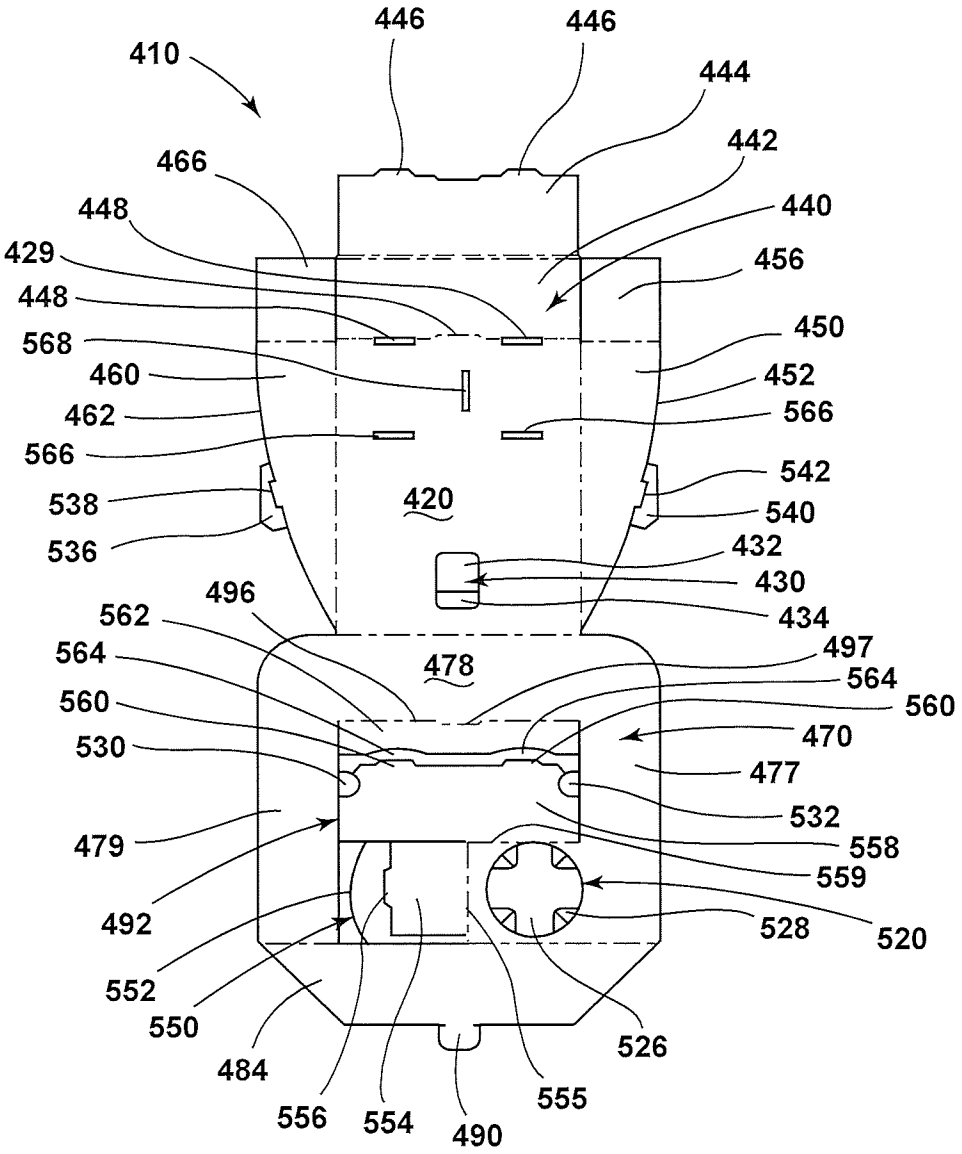
FIG. 7 is a top plan view of a third embodiment of a one-piece blank made of a foldable material.

The blank 410 depicted in FIG. 7 is identical in many ways to blank 210 depicted in FIG. 4. The blank 410 and resulting tray 412 include a cup holder 520 with extensions 528. The blank 410 also includes polygonal slotted tabs 536, 540, as well as tabs 530, 532 for insertion into defined slots 538, 542.

The 410 blank includes a holding space 550 similar in size to the cup holder 520, which could be used for something such as a smaller food item, for example a french fry container. The structure to create the holding space 550 includes a panel with an outer edge 552, which may be curved, and an inner panel 554 with a tab 556 extending from an edge of the panel 554 generally in the direction of the outer edge 552.

An inner wall panel 558 is also included which preferably extends the entire width of the open space 492 and has tabs 560 extending therefrom toward the rear of the blank 410. Instead of a multi-piece support portion 294, this embodiment includes an inner flap 562 that, in the blank form, is adjacent to the panel 558, and which preferably includes recesses 564 to account for the space taken by the tabs 560. The bottom panel 420 includes two opposing slots 566 which are positioned and configured to receive the tabs 560. The bottom panel 420 also includes a perpendicularly extending central slot 568 which is positioned and configured to receive the tab 556.

Figure 8:
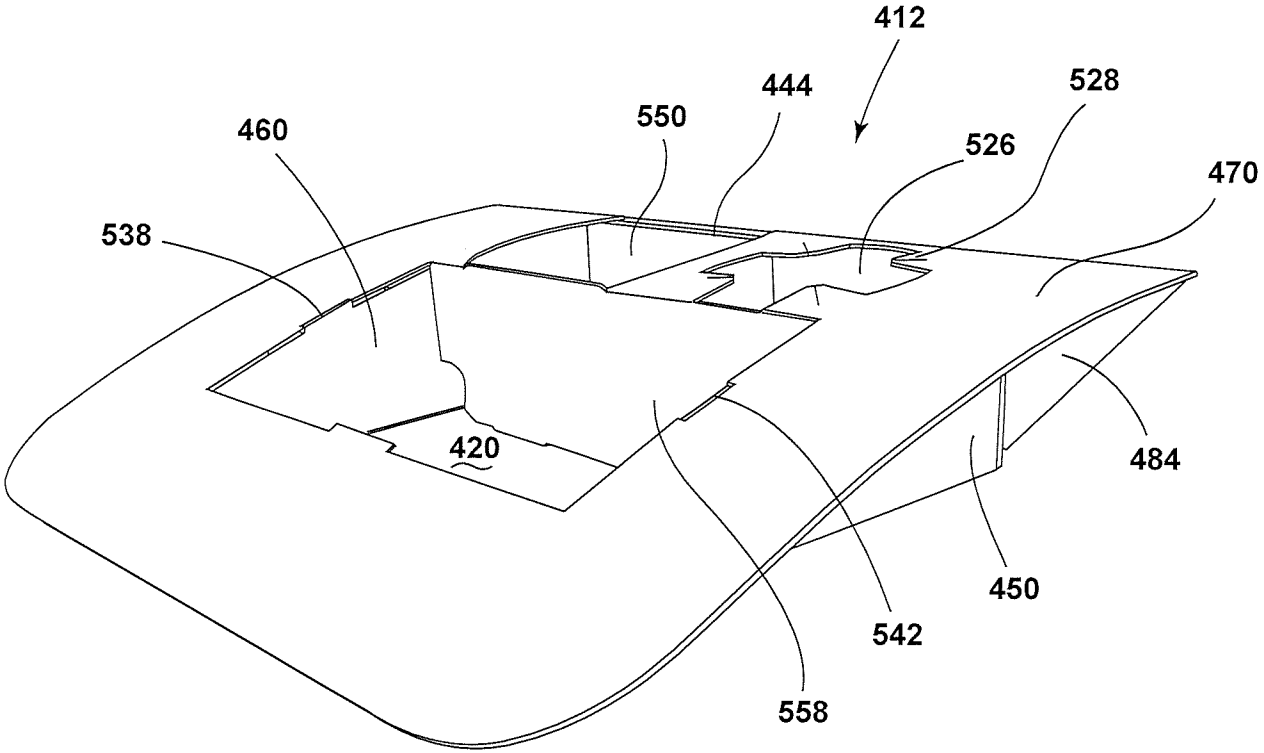
FIG. 8 is a front perspective view of a tray formed from the blank illustrated in FIG. 7.
Figure 9:
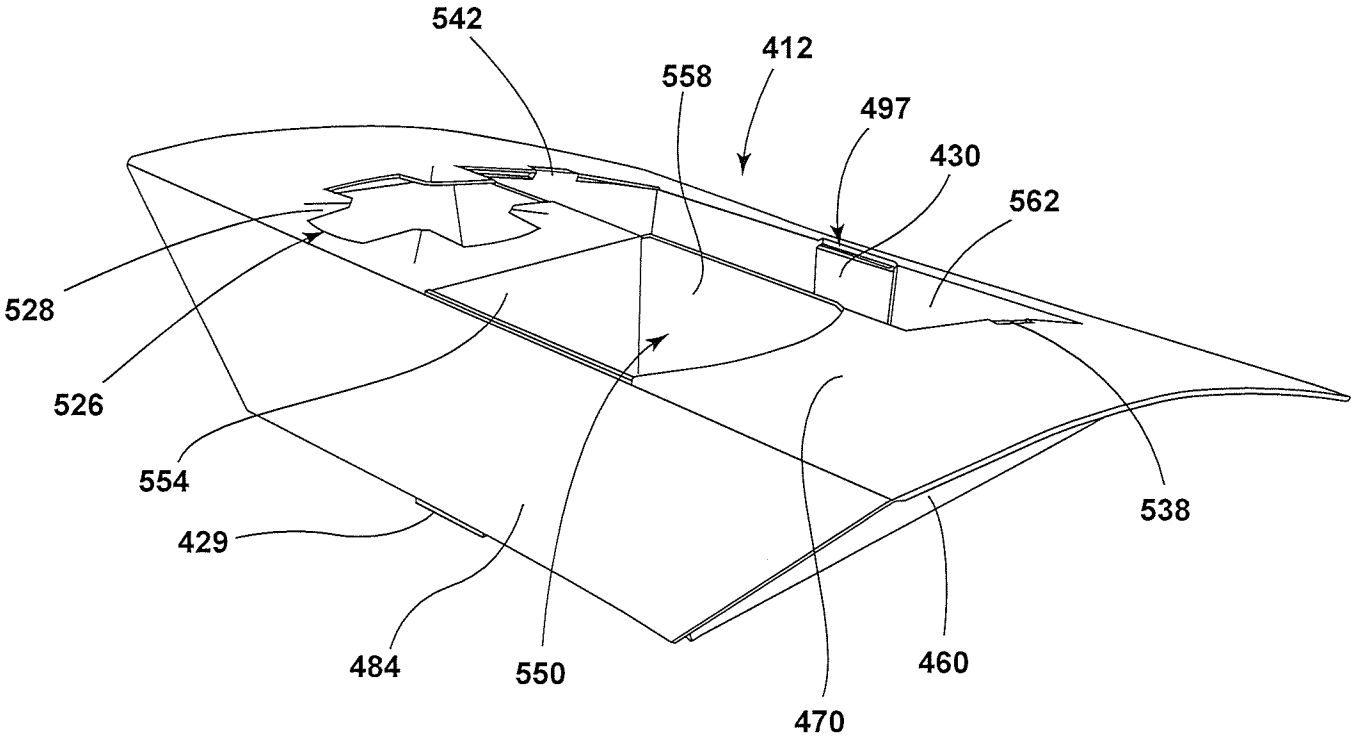
FIG. 9 is a rear perspective of the tray of FIG. 8.

Erecting the blank 410 into the tray 412, as shown in FIGS. 8 and 9, is substantially similar to that described above with respect to the blank 210. However, during the process, the panel 558 is folded downwardly about a fold line 559, and the tabs 560 are inserted into the slots 566, creating an inner wall in the inner space 492. Also, the panel 554 is bent downwardly about a fold line 555 and the tab 556 is inserted into the slot 568 to hold the panel 554 upright and securely in place. The panel 554 thus creates a wall and a separation between the cup holder 520 and the space 550, and effectively creates a tray with three open compartments for food or other items. Also during the erection, the panel 562 is bent downwardly at the fold line 496 such that it is substantially perpendicular to the plane in which the bottom panel 420 resides. The insertion of the tab 430 into the slot 497 holds the panel 562 securely in place.

The above-described embodiments of the tray made of a one-piece blank have a number of benefits when compared to current structures. The embodiments of the present invention allow easy erection of the tray and a very versatile product that can be used to store or retain a variety of different items of varying sizes and shapes.

Although the invention has been described with reference to a particular arrangement of parts, features and the like, these are not intended to exhaust all possible arrangements or features, and indeed many modifications and variations will be ascertainable to those of skill in the art.

The invention claimed is:

1. A tray made from a one-piece blank, the tray comprising:

a substantially planar and rectangular base having a pair of substantially parallel and spaced-apart front and rear edge portions and a pair of substantially parallel and spaced-apart side edge portions oriented transversely to the front and rear edge portions, the base further including a top surface and a bottom surface facing away from the top surface, the bottom surface during use of said tray configured to rest on a support surface;

a first sidewall connected to and projecting upwardly from one of the side edge portions of the base, the first sidewall having a curved upper edge;

a second sidewall connected to and projecting upwardly from the other said side edge portion of the base, the second sidewall having a curved upper edge;

a rear wall connected to and projecting upwardly from the rear edge portion of the base;

the curved upper edges of the first and second sidewalls each having an edge configuration curving downwardly as the curved upper edges project in a direction from the rear wall and towards the front edge portion of the base; and a top panel having a pair of laterally-spaced apart top panel portions respectively disposed atop the curved upper edges of the first and second sidewalls such that the top panel portions substantially adopt the edge configurations of the curved upper edges and curve downwardly as the top panel portions project in a direction from the rear wall and towards the front edge portion of the base.

2. The tray of claim 1, wherein the rear wall has a lower edge portion connected to the rear edge portion of the base and an upper edge portion spaced upwardly from the lower edge portion, the front and rear edge portions of the base are co-planar, the top panel portions extend from the upper edge portion of the rear wall to the front edge portion of the base such that the top wall portions curve smoothly and continuously downwardly as the top panel portions project from the rear wall to the front edge portion of the base.

3. The tray of claim 1, wherein the top panel portions are first and second top panel portions and the top panel has a third top panel portion oriented transversely to and interconnecting the first and second top panel portions.

4. The tray of claim 1, wherein the top portion has a top portion edge which is entirely disposed substantially along a first longitudinal axis, a first portion of the top portion edge connected to the base, and a second portion of the top portion edge not connected to the base.

5. The tray of claim 1, wherein when the base is in a substantially horizontal plane, the outer strip extends at least to a vertical plane in which the front of the base resides.

6. A tray made from a one-piece blank, the tray comprising:

a substantially planar and rectangular base having a pair of substantially parallel and spaced-apart front and rear edge portions and a pair of substantially parallel and spaced-apart side edge portions oriented transversely to the front and rear edge portions, the base further including a top surface and a bottom surface facing away from the top surface, the bottom surface during use of said tray configured to rest on a support surface;

a first sidewall connected to and projecting upwardly from one of the side edge portions of the base, the first sidewall having a curved upper edge with a curved edge configuration;

a second sidewall connected to and projecting upwardly from the other said side edge portion of the base, the second sidewall having a curved upper edge with a curved edge configuration;

a rear wall connected to and projecting upwardly from the rear edge portion of the base;

the curved upper edges of the first and second sidewalls each having an edge configuration curving downwardly as the curved upper edges project in a direction from the rear wall and towards the front edge portion of the base; and a top panel having a top panel portion strip disposed in supportive engagement with the curved upper edges of the first and second sidewalls such that the top panel substantially adopts the respective curved edge configurations of the curved upper edges and curves downwardly as the top panel portion projects in a direction away from the rear wall and towards the front edge portion.

7. The tray of claim 6, wherein the top portion has a top portion edge which is entirely disposed substantially along a first longitudinal axis, a first portion of the top portion edge connected to the base, and a second portion of the top portion edge not connected to the base.

8. The tray of claim 6, wherein when the base is in a substantially horizontal plane, the outer strip extends at least to a vertical plane in which the front of the base resides.

9. The tray of claim 6, further comprising a space adjacent both the first rear wall portion and the base.

10. The tray of claim 9, further comprising a tab connected to the second rear wall portion and being inserted into the space.

* * * * *